US006015072A

United States Patent [19]

Young

[11] Patent Number: 6,015,072

[45] Date of Patent: Jan. 18, 2000

[54] COMBINATION BACKPACK WITH LINED CONTAINER

[75] Inventor: David Young, Taipei, Taiwan

[73] Assignee: G & A Trading Company, City of Industry, Calif.

[21] Appl. No.: 09/158,241

[22] Filed: Sep. 22, 1998

[51] Int. Cl.[7] ..... A45F 4/02

[52] U.S. Cl. ..... 224/153; 224/581; 224/645; 190/103; 383/4; 383/40; 383/111; 383/113

[58] Field of Search ..... 224/575, 153, 224/576–582, 600, 610, 614, 617, 627, 645, 650, 652, 653, 654, 655, 656; 383/4, 38, 40, 111, 113; 190/103

[56] References Cited

U.S. PATENT DOCUMENTS

| | | | |
|---|---|---|---|
| 3,122,225 | 2/1964 | Ward | 190/109 X |
| 3,422,867 | 1/1969 | Wu | 383/111 X |
| 3,989,080 | 11/1976 | Koszegi | 383/40 |
| 4,018,369 | 4/1977 | Jaeger | 224/582 |
| 4,096,978 | 6/1978 | Noice | 383/40 |
| 4,506,769 | 3/1985 | Franco et al. | 224/653 X |
| 4,648,121 | 3/1987 | Lowe | 224/652 X |
| 4,929,094 | 5/1990 | Becker | 383/111 X |
| 4,940,173 | 7/1990 | Jacober | 224/153 |
| 4,941,603 | 7/1990 | Creamer et al. | 224/653 X |
| 5,119,910 | 6/1992 | Heggeland | 224/617 |
| 5,526,924 | 6/1996 | Klutznick | 383/111 X |
| 5,797,529 | 8/1998 | Lavine | 383/4 X |
| 5,887,770 | 3/1999 | Covell | 224/153 |

FOREIGN PATENT DOCUMENTS

| | | | |
|---|---|---|---|
| 1059597 | 3/1954 | France | 383/111 |
| 1474951 | 3/1967 | France | 190/103 |
| 2155168 | 9/1985 | United Kingdom | 224/153 |

*Primary Examiner*—Gregory M. Vidovich
*Attorney, Agent, or Firm*—David J. Arthur

[57] ABSTRACT

A combination collapsible backpack and lined compartment includes a backpack formed of a back section, a front section any bottom section attached to the front section and back section. The backpack further includes a pair of shoulder straps attached to the back section. The backpack may be collapsed onto the bottom section of the backpack. An upper lid is attached to the backpack, and the lid attachment attaches the bottom section of the backpack and the upper lid when the backpack is collapsed onto the bottom section of the backpack, so that the collapsed backpack is between the bottom section of the backpack and the lid. A carrying compartment has side walls and a bottom wall. A compartment attachment attaches the side walls of the carrying compartment to the bottom section of the backpack so that the bottom section of the backpack forms a top section of the carrying compartment. A liner having side walls and a bottom wall, which substantially correspond with the side walls and bottom section of the carrying compartment, is removably placed in the carrying compartment. A liner attachment detachably attaches the side walls of the liner with the side walls of the first compartment.

21 Claims, 4 Drawing Sheets

COMBINATION BACKPACK WITH LINED CONTAINER

RELATED APPLICATIONS

Not applicable.

FEDERALLY SPONSORED RESEARCH

Not applicable.

FIELD OF THE INVENTION

The present invention relates generally to luggage, and particularly to soft luggage made of fabric or similar material. In further particularity, the invention relates to compact luggage intended for day or short-term use.

BACKGROUND OF THE INVENTION

Many types of compact luggage pieces have been developed and are available for use to carry relatively small items. Such compact luggage pieces are useful for short excursions or day trips.

A popular style of luggage is the compact backpack. Such a backpack may include shoulder straps so it may be worn over a person's shoulders, on his or her back. The shoulder straps may be padded. A compact backpack may be used to carries school books, to carry extra clothing such as a jacket during a day trip, to carry equipment, or for many other uses.

Also popular are small, hand-held containers for carrying food items or other supplies. Such small containers may have a handle or strap to facilitate carrying. Some of these containers are insulated to help maintain the temperature of the articles within the container. Such insulated containers may be used for carrying a lunch or a few containers of a beverage. Because the food items that may be carried in such a container may spill, the interior surface of the container is typically washable. The interior surface is also water resistant so that as moisture condenses within the container, the condensation is contained within the interior of the container.

SUMMARY OF THE INVENTION

The present invention is a combination collapsible backpack and carrying compartment. The backpack portion includes a backpack back section, a backpack front section, and a backpack bottom section that is attached to the backpack front and to the backpack back. The backpack further includes a pair of shoulder straps attached to the backpack back section. The backpack may be collapsed onto the bottom section of the backpack. An upper lid is attached to the backpack, and a lid attachment attaches the backpack bottom and the upper lid when the backpack is collapsed onto the backpack bottom, so that the collapsed backpack is contained between the backpack bottom and the upper lid. The carrying compartment has side walls and a bottom. A compartment attachment attaches the side walls of the carrying compartment and backpack bottom.

In a particular embodiment, the lid attachment includes a hinge attaching a portion of the upper lid to a corresponding portion of the backpack bottom, and a zipper attaching an additional portion of the upper lid and a corresponding portion of the backpack bottom. In addition, the compartment attachment between the backpack bottom and the carrying compartment may include a compartment attachment hinge attaching one of the side walls of the carrying compartment to a portion of the backpack bottom, and a zipper attaching at least another of the side walls of the carrying compartment to another portion of the backpack bottom.

In accordance with an additional aspect of the present invention, a liner having side walls and a bottom wall fits into the carrying compartment. The liner comprises liner side walls and a liner bottom that substantially correspond with the side walls and bottom of the carrying compartment. A liner attachment detachably attaches the side walls of the liner with the side walls of the carrying compartment.

In a particularly preferred embodiment, the side walls and bottom section of the liner are formed of a substantially waterproof material, and are sealed to one another so that the liner forms a substantially water tight bin.

DETAILED DESCRIPTION OF A PREFERRED EMBODIMENT

Referring to FIGS. 1–5, a preferred embodiment of the luggage piece 10 incorporating the combination of the present invention is illustrated. The luggage piece may be formed of any several commonly available materials. A woven nylon fabric, such as is commonly used in soft sided luggage, is particularly advantageous. However, those familiar with the luggage arts, with the teaching of the following description, will recognize that other materials, both hard and soft, may be used for the body of the structure.

Figure 4:
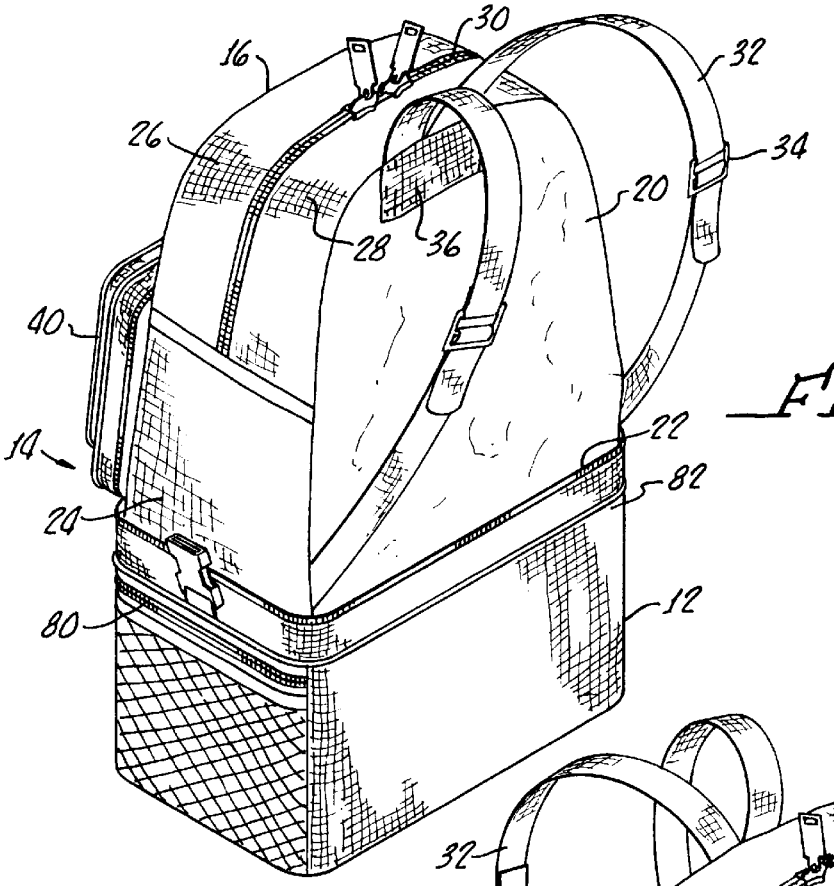
FIG. 4 is a perspective view of the back side of the luggage piece of FIG. 1, showing the backpack expanded.
Figure 5:
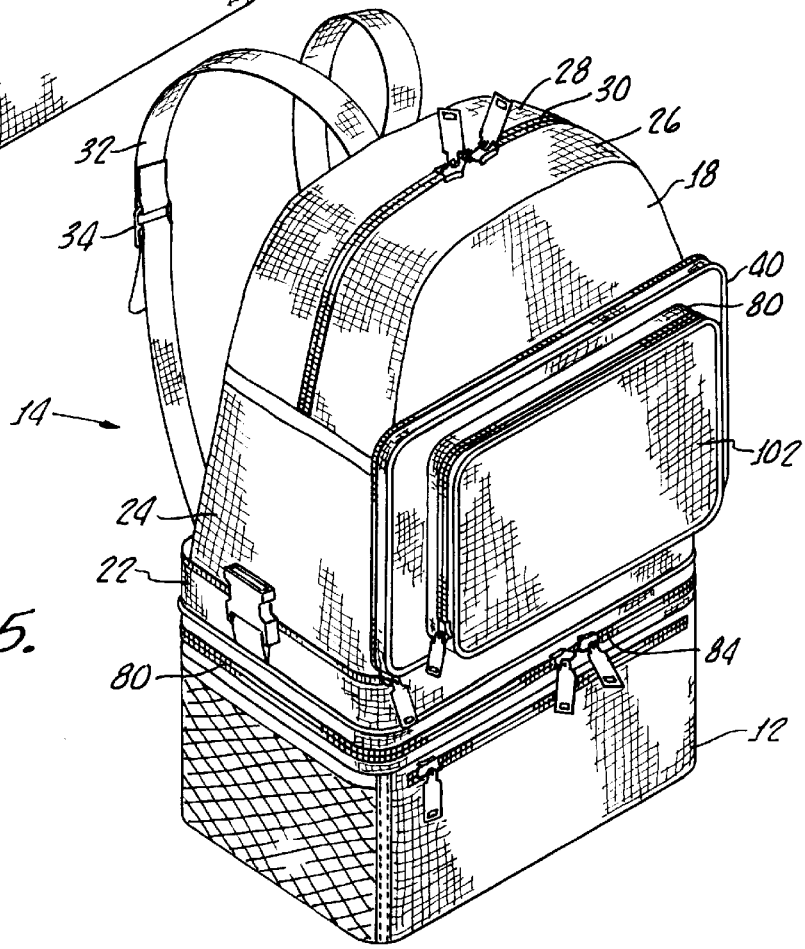
FIG. 5 is a different perspective view of the front side of the luggage piece of FIG. 1, showing the backpack expanded.

The luggage piece 10 includes a lower portion 12 and an upper portion 14. Referring to FIGS. 4 and 5, the upper portion of the luggage piece includes a backpack 16. The backpack 16 is preferably formed of a flexible fabric material, such as a woven nylon fabric. The flexible fabric material is ideally thin, lightweight, and easily foldable.

The backpack 16 includes a front section 18, a back section 20, and a bottom section 22. The backpack may also include side sections 24, and front and back top sections 26, 28. The front and back top sections 26, 28 may be joined at the top using a backpack closure, such as a zipper 30. With the backpack closure closed, the front, back, and side sections of the backpack enclose a backpack space.

Attached to the back section 20 of the backpack are two shoulder straps 32. The shoulder straps 32 may be slightly padded. In addition, the length of each shoulder strap is preferably adjustable. For example, an adjustment buckle 34 may be included on each shoulder strap. The construction of such shoulder straps is well understood in the art. One end of each shoulder strap 32 may be attached near or at the point at which the back section 20 and the backpack bottom 22 join. The other end of each shoulder strap 32 may be attached at the top edge of the back section 20 of the backpack. Additional reinforcing 36 may be included at the top of the back section of the backpack, where the shoulder straps are attached.

The backpack 16 may be collapsed onto the backpack bottom 22 by folding the backpack front and back sections 18, 20 together, and folding the shoulder straps 32 upon themselves.

The upper portion 14 of the luggage piece additionally includes an upper lid 40. The luggage piece further includes a lid attachment 42 for attaching the bottom section 22 of the backpack to the upper lid 40 when the backpack is collapsed onto the backpack bottom, so that the collapsed backpack 16 is contained between the backpack bottom and the upper lid (See FIG. 3).

The lid attachment 42 may include a hinge 44 (see FIG. 1) connecting one edge of the backpack bottom 22 with a corresponding edge of the lid 40. The hinge 44 may be formed of a section of fabric sewn to the edge of the backpack bottom and the corresponding edge of the lid. The lid attachment may further include a zipper 46. The zipper 46 may attach at least some of the other sides of the backpack bottom with corresponding sides of the lid. For example, the zipper 46 may extend along the other three sides of the backpack bottom and the lid. Ideally, the zipper extends around to encompass a portion of the same edge of the lid as the hinge 44. This allows the lid to be opened more fully.

In the illustrated embodiment, the backpack bottom 22 includes a short fabric extension 48 extending substantially vertically along its four edges. This extension may be approximately ½ inch to 1 inch, to provide appropriate spacing between the backpack bottom 22 and the lid 40 to accommodate the backpack fabric between the backpack bottom and the lid when the backpack 16 is collapsed onto the backpack bottom. With the extension in place, the zipper 46 and the hinge 44 are attached to the edge of the backpack bottom extension 48.

The edge of the lid opposite the hinge is preferably attached to the front backpack section. As so attached, when the backpack is expanded as shown in FIGS. 4 and 5, the front lid 40 remains attached to the backpack, and does not move about unpredictably. The attachment may be provided by a few stitches of thread 50 (FIG. 3) connecting the front section of the backpack with the interior side of the lid 40, just inside the zipper 46 that forms part of the lid attachment.

Those skilled in the art will recognize that other types of attachment, such as snaps, overlapping tabs with snaps, buttons, or hook and loop fasteners, and so forth may also be used as lid attachments to attach the backpack bottom and the lid.

Figure 3:
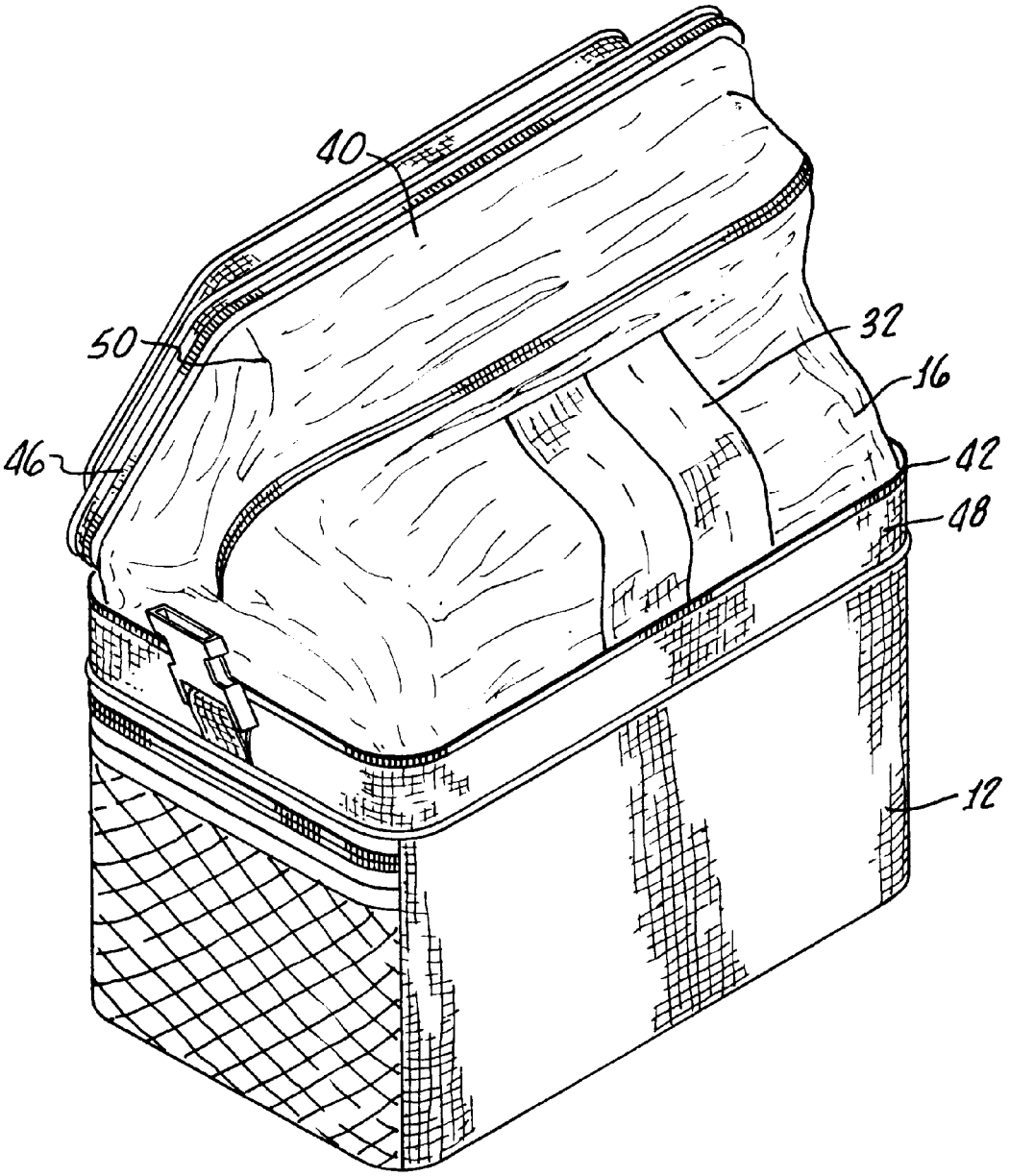
FIG. 3 is a perspective view of the luggage piece of FIG. 1, showing the backpack partially expanded.

Referring now specifically to FIG. 3, the luggage piece is shown with the upper lid 40 open. The backpack 16 is shown partially expanded, and partially collapsed onto the backpack bottom. Referring to FIG. 3 in connection with expanding the backpack from its collapsed position, the upper lid zipper 46 has been opened, allowing the upper lid 40 to be raised. With the upper lid raised, the backpack 16 is released from between the backpack bottom and the upper lid. The user may then pull on the shoulder straps 32, or on another portion of the backpack fabric, to pull the backpack away from the backpack bottom, until the backpack assumes its fully expanded position, shown in FIGS. 4 and 5.

Similarly, from the expanded position, the user can fold the backpack fabric upon itself onto the backpack bottom, until the backpack is substantially collapsed upon the backpack bottom. Then the user may press the upper lid 40 down over the collapsed backpack, and close the upper lid zipper 46.

The lower portion 12 of the luggage piece includes side walls 60, 61 and a bottom wall 62 defining a carrying compartment. The particular embodiment illustrated has a substantially rectangular carrying compartment. The carrying compartment may be sized, for example, to carry lunch items, or six cans of soda. However, those skilled in the art will recognize that the teachings of the present invention may be applied to virtually any size luggage piece, and that other shapes may be used.

In a preferred form, the side walls 60, 61 and bottom wall 62 of the carrying compartment are insulated to help items placed in the interior of the compartment maintain their temperature. Such insulation may be provided by forming the side walls and the bottom wall of two layers of fabric each, with a layer of insulation between the fabric layers. Such insulated structures are known in the art.

On the exterior of the lower portion of the luggage piece may be different types of external pockets for stashing small items. For example, one pocket (illustrated for exemplary purposes on the end of the compartment) may be formed of elastic netting 64 extending over the exterior surface of the side wall 61, topped by an elastic band 66. Another pocket (illustrated for exemplary purposes on the front of the compartment) may be formed of an additional layer of fabric 68 over the exterior surface of the side wall 60. The pocket may include a closure, such as a zipper 70 for attaching the top of the additional layer of fabric 68 to the compartment side wall 60. Those familiar with the art will recognize that the top of the pocket may be left open, or other types of closures may be used for such a pocket. Those familiar with the art will also recognize that other types of pockets may be incorporated. Other pockets may be included, for example, on the other end of the compartment, and on be back side of the compartment.

The backpack bottom 22 also forms a compartment lid, and is attached to the side walls 60, 61 forming the carrying compartment, so that the backpack bottom may be at least partially separated from the compartment side walls to permit access to the interior of the carrying compartment. The backpack bottom 22 is attached to the side walls by a compartment attachment. The compartment attachment may include a zipper 80 and a hinge 82. In the embodiment illustrated, the zipper 80 extends along the upper edge of each of three of the compartment walls 60, 61, and along a corresponding three edges of the backpack bottom 22. Also in the illustrated embodiment, two zipper heads 84 are used to secure the zipper around the three sides of the compartment. The fourth edge of the backpack bottom is attached to the fourth compartment side wall by a hinge 82 formed of a length of fabric that is sewn to the backpack bottom and to the fourth side wall of the compartment (see FIG. 4). Preferably, the hinge 82 of the compartment attachment is on the opposite side of the luggage piece from the hinge 44 of the upper lid. Referring to FIG. 5, the opposite placement of the compartment attachment hinge 82 and the upper lid hinge 44 permits access to the carrying compartment attachment zipper 80, even if the backpack 16 is being worn by a person.

Preferably, the backpack bottom 22 is also insulated against temperature changes. Thus, when the backpack bottom is closed, and the compartment attachment secures the backpack bottom to the compartment walls, the interior of the carrying compartment is insulated on all sides.

Figure 1:
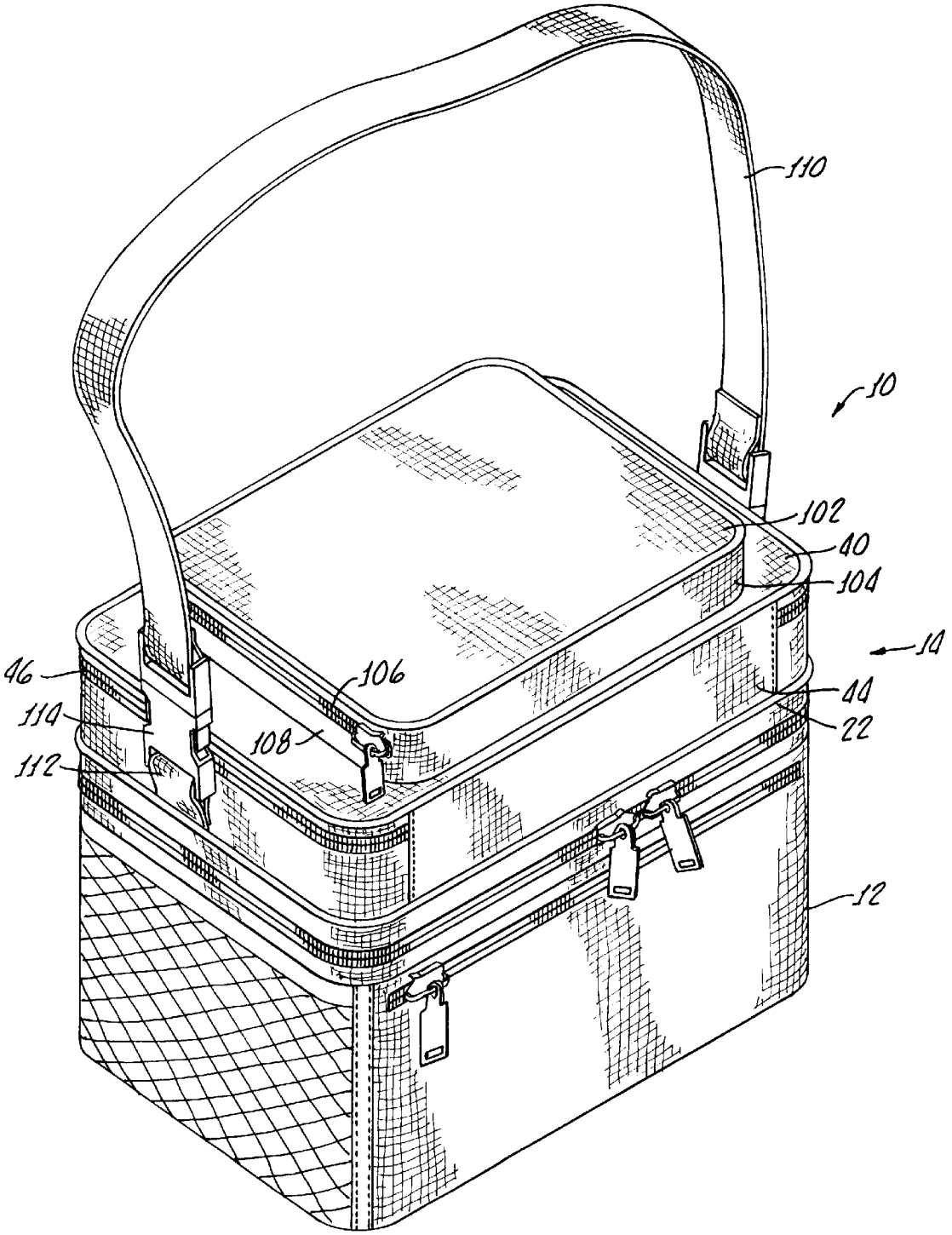
FIG. 1 is a perspective view of a luggage piece incorporating the combination of the present invention, showing the backpack portion collapsed.
Figure 2:
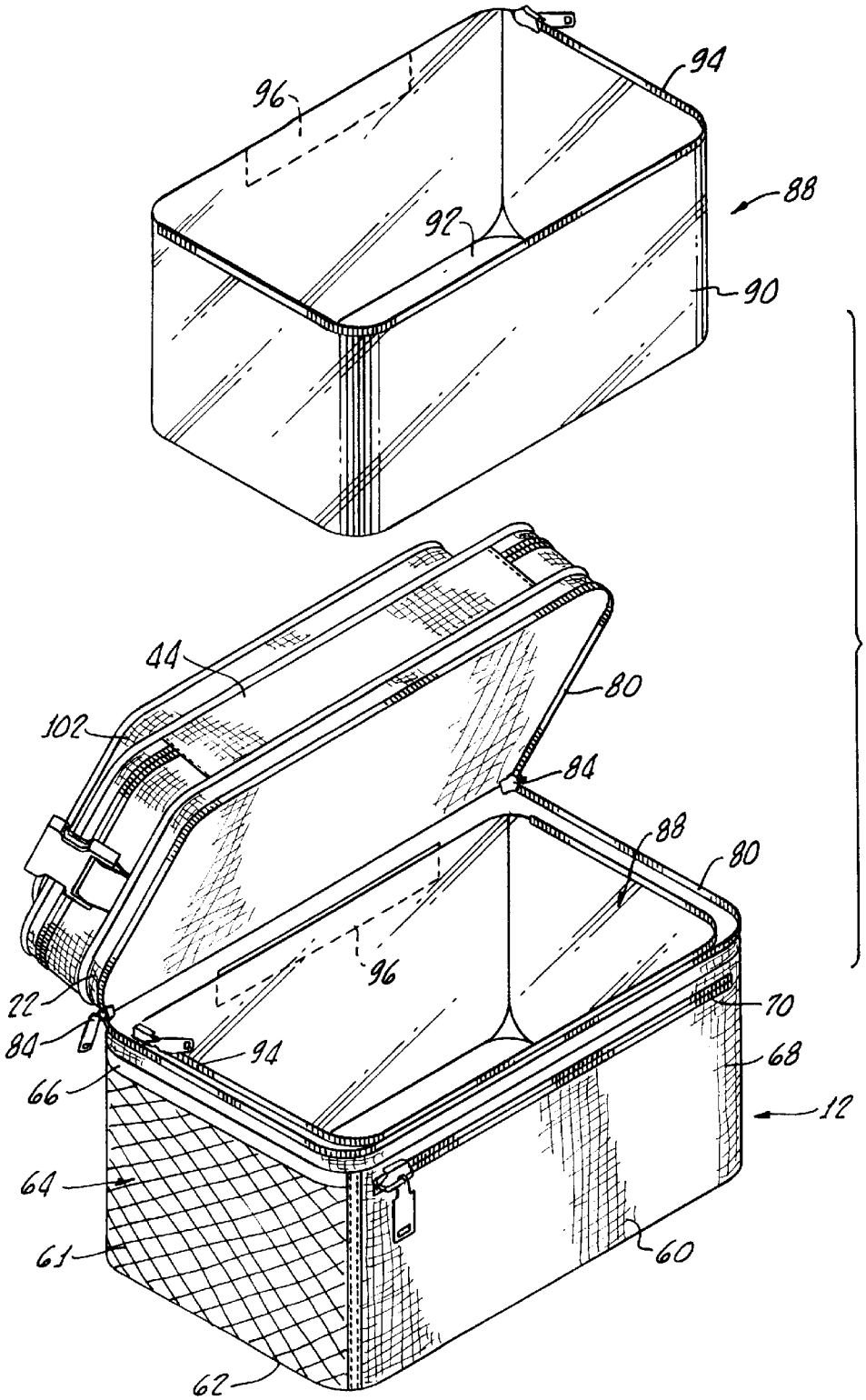
FIG. 2 is another perspective view of the luggage piece of FIG. 1, with the lined compartment portion open.

Referring now to FIG. 2, the interior on the carrying compartment is illustrated. In accordance with an aspect of the present invention, a removable liner 88 is included inside the lower compartment of the luggage piece. Such a removable liner helps to contain condensation and spills. The removable liner 88 facilitates cleaning of the luggage piece. The removable liner 88 is shown for illustrative purposes in FIG. 2 both inside the carrying compartment, and also removed from the carrying compartment.

The removable liner 88 is preferably formed of side walls 90 and a bottom wall 92, each of which corresponds to a corresponding side wall 60, 61 and bottom wall 62 of the compartment. A liner attachment, such as a zipper 94, secures the side walls 90 of the liner 88 with the side walls 60, 61 of the compartment. The liner attachment allows the liner to be completely detached from the carrying compartment, and removed from the compartment.

For example, in the embodiment illustrated in FIG. 2, the zipper 94 extends along the upper edge or near the upper edge of the interior surface of three walls 60, 61 of the carrying compartment, and along the corresponding three walls 90 of the liner 88. In the particular embodiment illustrated, the three walls to which the liner is attached by the zipper 94 are the same walls to which the backpack bottom 22 is attached by the compartment attachment zipper 80. The liner attachment additionally includes, in the preferred form, a "hook-and-loop" fastener 96, such as Velcro™ or a similar fastener. The hook-and-loop fastener 96 attaches the top of the fourth wall of the compartment to the top of the fourth wall of the liner 88. For example, a section of hooks may be attached to be interior surface of the fourth compartment wall, while a section of loops may be attached to the exterior service of the fourth wall of the liner.

The side walls 90 and bottom wall 92 or section of the liner are preferably formed of a material water does not permeate, such as a flexible vinyl or plastic. In addition, the side walls 90 and bottom walls 92 of the liner 88 are attached to one another with a substantially watertight seal so that the liner 88 forms a substantially waterproof bin. Such a waterproof bin allows condensation that may form around a cold item placed in the compartment to be contained within the liner, and also contains any spills that may occur from soiling the interior surfaces of the compartment.

The particular embodiment illustrated additionally includes an optional lid pocket 102 securely attached to the upper lid 40. This lid pocket 102 may be formed of a top flap attached to the lid by a top flap hinge 104. The top flap hinge 104 may be formed of a section of fabric connecting the lid 40 and one edge of the top flap. A top flap closure, such as a zipper 106, may extend around the other three edges of the top flap. In the particular embodiment illustrated, height is provided to the lid pocket by forming the pocket of four substantially vertical pocket walls 108. One of the pocket walls also forms the top flap hinge 104. The zipper 106 then connects the other three pocket walls 108 with the three edges of the top flap. The hinge 104 of the lid pocket is preferably located on the same side of the luggage piece as the hinge 44 for the upper lid, so that when the backpack 16 is in its expanded position as shown in FIG. 5, the lid compartment closure 106 faces upward.

The luggage piece may further include a detachable handle. The handle allows the luggage piece to be carried when the backpack is collapsed and stowed beneath the upper lid. In the particular embodiment illustrated, the handle is a flexible shoulder strap 110 formed of nylon webbing. The length of the strap 110 may be adjusted using a conventional strap adjustment mechanism (not shown). A pair of strap mounts 112 are sewn securely to the backpack bottom (which, as noted above, also forms the carrying compartment lid). To ease showing other features of the luggage piece, the strap mounts 112 are not shown in FIGS. 2–4. Each end of the shoulder strap 110 may be attached to a corresponding one of the strap mounts 112 by a latch 114. The latch 114 may be formed of molded plastic, or metal. Such straps and latches are well-known in the art.

The embodiment illustrated and described herein is exemplary only. Those skilled of the art will recognize that numerous modifications may be made to be embodiment described, without departing from the inventive concept. For example, different materials may be used for some or all of the complements. In particular, certain portions of the luggage piece may be formed of rigid plastic or other materials. In addition, different types of closures and attachments may be used. Furthermore, different sizes and shapes for the luggage piece may be envisioned.

I claim:

1. A combination backpack and carrying compartment, the combination comprising:

a backpack comprising a back section, a front section, a bottom section attached to the front section and the back section, and a pair of shoulder straps attached to the back section, wherein the backpack is collapsible onto the bottom section thereof;

an upper lid attached to the backpack;

a lid attachment for attaching the bottom section of the backpack and the upper lid when the backpack is collapsed onto the bottom section of the backpack, so that the collapsed backpack is between the bottom section of the backpack and the lid;

a carrying compartment having side walls and a bottom;

a compartment attachment between the side walls of the carrying compartment and the bottom section of the backpack;

a liner having side walls and a bottom wall, wherein the side walls and bottom wall of the liner substantially correspond with the side walls and bottom of the carrying compartment; and a liner attachment for detachably attaching the side walls of the liner with the side walls of the carrying compartment.

2. The combination of claim 1, wherein the lid attachment comprises a zipper.

3. The combination of claim 1, wherein the liner attachment attaches the side walls of the liner with the interior surfaces of the side walls of the carrying compartment.

4. The combination of claim 1, wherein the side walls and bottom wall of the liner are sealed to one another so that the liner forms a substantially water tight bin.

5. The combination of claim 4, wherein the side walls of the carrying compartment are insulated.

6. A combination backpack and first compartment, the combination comprising:

a backpack comprising a back section, a front section, a bottom section attached to the front section and the back section, and a pair of shoulder straps attached to the back section, wherein:

the front section and the back section are attachable to one another to substantially enclose a backpack space; and the backpack is collapsible onto the bottom section thereof;

an upper lid attached to the backpack;

a lid attachment for attaching the bottom section of the backpack and the upper lid when the backpack is collapsed onto the bottom section of the backpack, so that the collapsed backpack is between the bottom section of the backpack and the lid;

a first compartment having side walls and a bottom;

a compartment attachment between the side walls of the first compartment and the bottom section of the backpack;

a liner having side walls and a bottom wall, wherein the side walls and bottom wall of the liner substantially correspond with the side walls and bottom of the first compartment; and a liner attachment for detachably attaching the side walls of the liner with the side walls of the first compartment.

7. The combination of claim 6, wherein the lid attachment comprises:

a hinge attaching a portion of the upper lid to a corresponding portion of the bottom section of the backpack; and a zipper attaching an additional portion of the upper lid and a corresponding portion of the bottom section of the backpack.

8. The combination of claim 7, wherein the compartment attachment comprises:

a hinge attaching one of the side walls of the first compartment to a portion of the bottom section of the backpack; and a zipper attaching at least another of the side walls of the first compartment to another portion of the bottom section of the backpack.

9. The combination of claim 8, wherein the lid attachment comprises:

a substantially vertical extension from the bottom section of the backpack, wherein a portion of the extension is secured to a corresponding portion of the upper lid to define said hinge.

10. The combination of claim 7, wherein the side walls and bottom wall of the liner are sealed to one another so that the liner forms a substantially water tight bin.

11. The combination of claim 10, wherein the side walls of the first compartment are insulated.

12. A combination backpack and insulated compartment, comprising:

a backpack formed of flexible fabric, the backpack comprising:

a back section;

a front section;

a bottom section attached to the front section and the back section; and a pair of shoulder straps attached to the back section; and a zipper for attaching the front section and the back section to one another to substantially enclose a backpack space;

wherein the backpack is collapsible onto the bottom section thereof;

an upper lid having a first edge attached to the bottom section of the backpack, and having a second edge attached to the front section of the backpack so that when the backpack is collapsed onto the bottom section of the backpack, the collapsed backpack is between the bottom section of the backpack and the lid;

a lid attachment for attaching the bottom section of the backpack and the upper lid when the backpack is collapsed onto the bottom section of the backpack to contain the collapsed backpack between the bottom section of the backpack and the lid;

a plurality of insulated side walls and a compartment bottom attached to the side walls, defining an insulated compartment;

a compartment attachment for attaching the side walls of the insulated compartment to the bottom section of the backpack so that the bottom section of the backpack forms a top for the insulated compartment;

a liner having side walls and a liner bottom, wherein the liner fits inside the insulated compartment defined by the side walls and compartment bottom of the insulated compartment; and a liner attachment for detachably attaching the side walls of the liner to the interior surface of the side walls of the insulated compartment.

13. The combination of claim 12, wherein:

the side walls and the liner bottom are formed of plastic; and the side walls and liner bottom of the liner are sealed to one another so that the liner forms a substantially watertight bin.

14. The combination of claim 13, wherein the liner attachment comprises a zipper.

15. The combination of claim 13, wherein the liner attachment comprises hook and loop fasteners.

16. The combination of claim 12, wherein the compartment attachment comprises:

a section of fabric securing one of the side walls of the insulated compartment to the bottom section of the backpack; and a zipper for attaching at least another of the side walls of the insulated compartment to the bottom section of the backpack.

17. The combination of claim 16, wherein the lid attachment comprises a zipper for attaching the second edge of the lid to the bottom section of the backpack.

18. A combination backpack and carrying compartment, the combination comprising:

a backpack comprising a back section, a front section, a bottom section attached to the front section and the back section, and a pair of shoulder straps attached to the back section, wherein the backpack is collapsible onto the bottom section thereof;

an upper lid attached to the backpack;

a lid attachment for attaching the bottom section of the backpack and the upper lid when the backpack is collapsed onto the bottom section of the backpack, so that the collapsed backpack is between the bottom section of the backpack and the lid;

a carrying compartment having side walls and a bottom, wherein the side walls of the carrying compartment are insulated; and a compartment attachment between the side walls of the carrying compartment and the bottom section of the backpack.

19. The combination of claim 18, additionally comprising:

a liner having side walls and a bottom wall, wherein the side walls and bottom wall of the liner substantially correspond with the side walls and bottom of the carrying compartment; and a liner attachment for detachably attaching the side walls of the liner with the side walls of the carrying compartment.

20. The combination of claim 19, wherein the liner attachment attaches the side walls of the liner with the interior surfaces of the side walls of the carrying compartment.

21. The combination of claim 20, wherein the side walls and bottom wall of the liner are sealed to one another so that the liner forms a substantially water tight bin.

* * * * *